US006210121B1

(12) United States Patent
Sprenger et al.

(10) Patent No.: US 6,210,121 B1
(45) Date of Patent: Apr. 3, 2001

(54) METHOD OF CALIBRATING A LOST-MOTION METERING PUMP

(75) Inventors: Henry K. Sprenger, Huntingdon Valley; Joel E. Higbee, Horsham; Walter P. Telly, Perkasie, all of PA (US)

(73) Assignee: Milton Roy Company, Ivyland, PA (US)

( * ) Notice: Subject to any disclaimer, the term of this patent is extended or adjusted under 35 U.S.C. 154(b) by 0 days.

(21) Appl. No.: 09/309,809

(22) Filed: May 11, 1999

(51) Int. Cl.[7] ..... F04B 19/24; F01B 31/14

(52) U.S. Cl. ..... 417/53; 92/60.5

(58) Field of Search ..... 417/53, 60, 274; 222/321.7, 57; 137/1, 605, 553; 184/6.4, 7.4; 52/60.5

(56) References Cited

U.S. PATENT DOCUMENTS

| | | | | |
|---|---|---|---|---|
| 1,320,845 | | 11/1919 | Dayton et al. . | |
| 1,391,104 | | 9/1921 | Gould . | |
| 1,932,921 | * | 10/1933 | Bizzarri | 92/60.5 |
| 2,047,167 | * | 7/1936 | Heller | 92/60.5 |
| 2,756,907 | | 7/1956 | Hill | 222/250 |
| 3,497,111 | | 2/1970 | Savage | 222/146 |
| 3,834,839 | | 9/1974 | Krebs et al. | 417/505 |
| 3,921,664 | * | 11/1975 | Almquist | 137/553 |
| 3,922,957 | | 12/1975 | Ogle et al. | 92/137 |
| 4,309,156 | | 1/1982 | Gonner et al. | 417/403 |
| 4,453,380 | | 6/1984 | Meynier | 60/534 |
| 4,648,533 | | 3/1987 | Rasmussen | 222/309 |
| 4,770,198 | * | 9/1988 | Bergman | 137/1 |
| 5,154,107 | | 10/1992 | Morin et al. | 92/13.3 |
| 5,299,446 | | 4/1994 | Pardinas et al. | 73/3 |
| 5,462,115 | * | 10/1995 | Belden et al. | 166/177.3 |
| 5,494,078 | | 2/1996 | Schulte | 137/630.14 |
| 5,687,884 | * | 11/1997 | Bodin et al. | 222/321.7 |
| 5,971,107 | * | 10/1999 | Stitz et al. | 184/7.4 |

OTHER PUBLICATIONS

Milton Roy Metering Pump Technology—Bulletin 210 (dated Jul. 1998).

Report entitled "Diaphragm Pumps" authored by Stephen D. Able, Robert Bean, Warren E. Rupp (undated).

* cited by examiner

*Primary Examiner*—Charles G. Freay

(57) ABSTRACT

A method of calibrating a lost-motion metering pump is disclosed wherein the pump includes a relief port, a movable hollow plunger having a bypass hole which is aligned with the relief port when the plunger is moved to an aligned position and a control rod extending into the hollow plunger. According to one aspect, the method includes the steps of moving the plunger to the aligned position, inserting a gage pin through the relief port and the bypass hole into the plunger, moving the control rod into engagement with the gage pin and fixing the position of the control rod.

18 Claims, 9 Drawing Sheets

METHOD OF CALIBRATING A LOST-MOTION METERING PUMP

TECHNICAL FIELD

The present invention relates generally to metering pumps, and more particularly, to a method of calibrating a lost-motion metering pump.

BACKGROUND ART

In order to minimize the variation in output flow of hydraulic lost-motion metering pumps from one pump to another, it is necessary to perform a calibration procedure on each pump. The parameter that a user is most concerned with is the amount of fluid that is pumped over a given time. This parameter, in turn, is determined by the physical relationship between a bypass hole located in a hollow plunger and a control rod extending into the hollow plunger. Currently, this relationship is adjusted during a calibration procedure, which is conducted before filling of a pump reservoir, by an air gauging setup. Briefly, the air gauging setup measures the pressure drop across the bypass hole when the hollow plunger is disposed at a certain position. If a standardized pressure drop value is used for all pumps of a given configuration, then one can be assured that flow performance variations will be minimized. This pressure drop is related to the amount of air flowing through the bypass hole, which is, in turn, related to the equivalent size of the bypass hole when the plunger is at the certain position. The size of the bypass at the time that the plunger is disposed at the certain position can be adjusted by changing the position of the control rod relative to the bypass hole. Typically, a stamped metal linkage is bent to accomplish the actual adjustment of control rod position.

Bending the metal linkage to obtain the desired pressure drop value is a lengthy and tedious process. In addition, calibration must be performed very early in the assembly process. If it ever becomes necessary to re-calibrate the pump, substantial disassembly of the pump is required. Furthermore, if re-calibration of the pump is required once the pump is installed, either the pump will have to be returned to the manufacturer or an air gauge setup will have to be provided at the installation site.

SUMMARY OF THE INVENTION

In accordance with one aspect of the present invention, a method of calibrating a lost-motion metering pump is provided wherein the pump includes a relief port, a movable hollow plunger having a bypass hole which is aligned with the relief port when the plunger is moved to an aligned position and a control rod extending into the hollow plunger. The method includes the steps of moving the plunger to the aligned position, inserting a gage pin through the relief port and the bypass hole into the plunger, moving the control rod into engagement with the gage pin and fixing the position of the control rod.

Preferably, the step of fixing comprises the step of threading a retention nut into a control rod bore in which the control rod is disposed. Also preferably, the control rod includes a bore that receives an anti-rotation pin and the method includes the further step of inserting a hollow seal cap having a slot into a pump housing and the step of moving the control rod comprises the step of inserting the control rod through the hollow seal cap such that the anti-rotation pin is disposed in the slot. Still further in accordance with the preferred embodiment, the step of fixing comprises the steps of inserting a hollow knob having a circumferential flange into the pump housing such that the hollow knob surrounds a portion of the control rod and a portion of the seal cap, securing the hollow knob to the control rod and threading a retention nut into the pump housing to capture the circumferential flange against the seal cap.

A threaded ring is preferably threaded onto the control rod and the step of securing the hollow knob to the control rod comprises the step of threading a set screw into engagement with the threaded ring.

In accordance with another aspect of the present invention, a method of calibrating a lost-motion metering pump is provided wherein the pump includes a pump housing having a control rod bore, a relief port formed in the pump housing and adapted to receive a relief valve assembly, a movable hollow plunger having a bypass hole which is aligned with the relief port when the plunger is moved to an aligned position and a control rod extending into the control rod bore and the hollow plunger. The method comprises the steps of moving the plunger to the aligned position, inserting a gage pin through the relief port and the bypass hole into the plunger while the relief valve assembly is removed from the relief port and inserting a hollow seal cap having a slot into the control rod bore. The control rod is placed into the control rod bore through the seal cap and into engagement with the gage pin. The position of the control rod is fixed by inserting a hollow knob having a circumferential flange into the second bore surrounding a portion of the control rod and a portion of the seal cap, securing the hollow knob to the control rod and threading a retention nut into the second bore to capture the circumferential flange and the seal cap against the pump housing.

In accordance with yet another aspect of the present invention, a method of calibrating a flow control assembly of a lost-motion pump is provided wherein the flow control assembly includes a control rod and a knob and the lost-motion pump includes a hollow plunger disposed in a pump housing. The method includes the steps of inserting the control rod into the hollow plunger, advancing the control rod into the hollow plunger until a particular portion of the control rod is aligned with respect to a certain portion of the pump housing and securing the knob to the control rod when the control rod is aligned with respect to the pump housing.

In accordance with a still further aspect of the present invention, a method of calibrating a flow assembly of a lost-motion pump wherein the flow control assembly includes a control rod and a knob and wherein the lost-motion pump includes a relief valve port and a hollow plunger disposed in a pump housing and having a bypass hole, includes the steps of advancing the hollow plunger to an extreme position such that the bypass hole is aligned with the relief port and installing a gauge pin through the relief valve port into the bypass hole. The control rod is inserted into the hollow plunger until the control rod contacts the gauge pin and an indicator is applied to at least one of the flow control assembly and the pump at an aligned position while the control rod is contacting the gauge pin to calibrate the flow control assembly.

In accordance with yet another aspect of the present invention, a method of calibrating a flow control assembly of a lost-motion pump, the flow control assembly including a control rod and a knob and the lost-motion pump including a hollow plunger disposed in a pump housing, includes the steps of inserting the control rod into the hollow plunger and advancing the control rod into the hollow plunger until a particular portion of the control rod is aligned with respect to a certain portion of the pump housing. An indicator is secured to at least one of the flow control assembly and the pump at an aligned position while the particular portion of the control rod is aligned with the certain portion of the pump housing to calibrate the flow control assembly.

Other aspects and advantages of the present invention will become apparent upon consideration of the following drawings and detailed description.

DESCRIPTION OF THE PREFERRED EMBODIMENT

Figure 1:
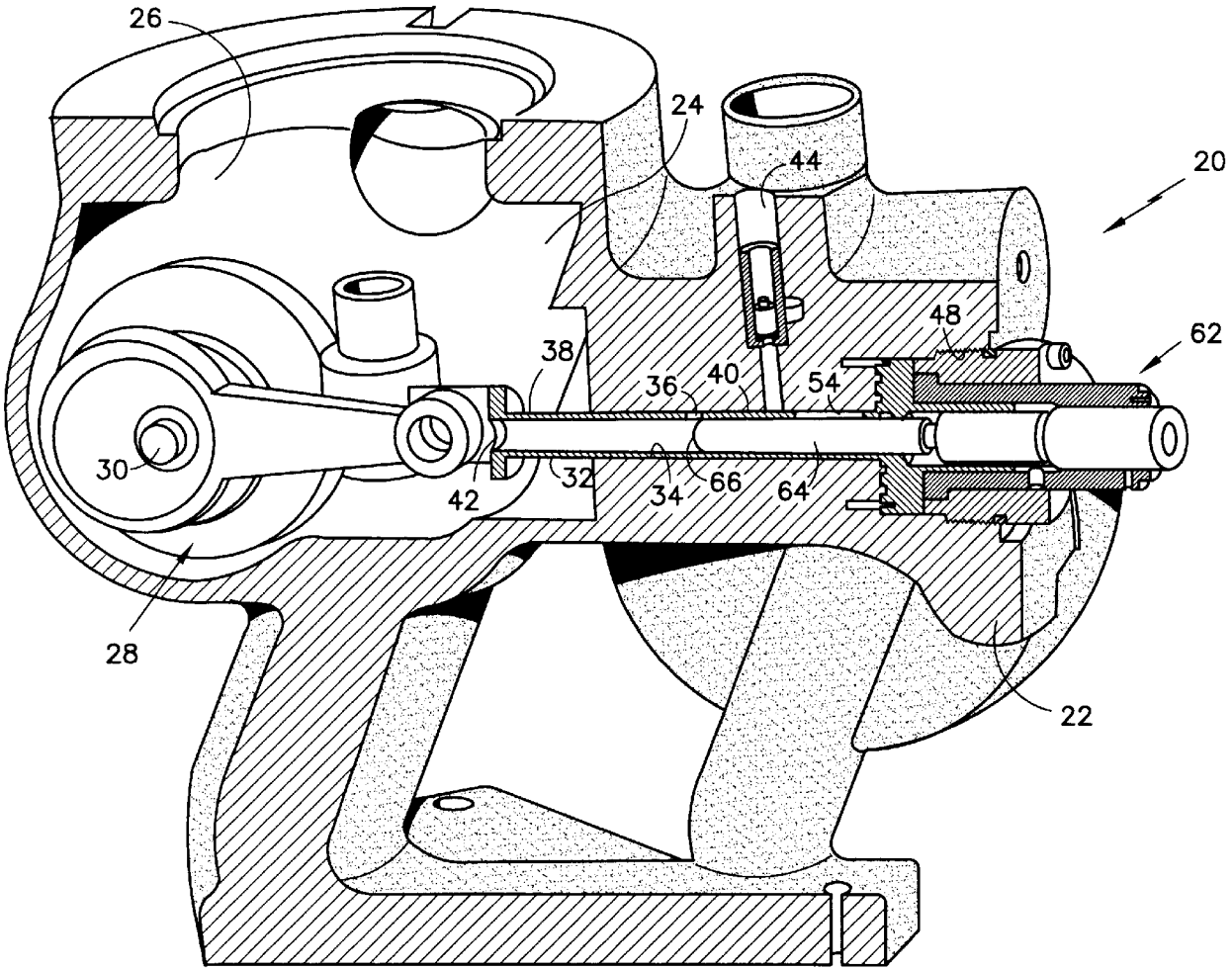
FIG. 1 comprises a trimetric view, with portions cut away, illustrating a hydraulic lost-motion metering pump that may be calibrated according to the method of the present invention.
Figure 4:
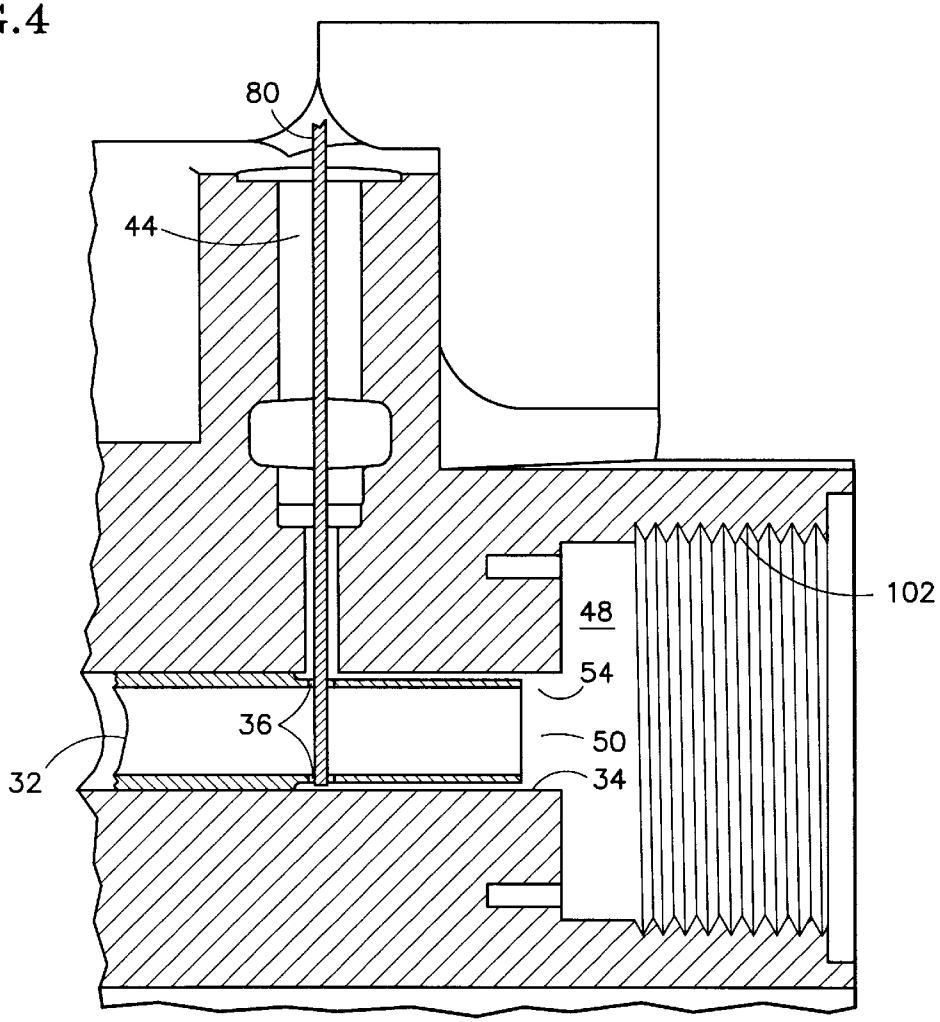
FIG. 4 comprises a full sectional view of the pump of FIG. 1 with the relief valve removed from the relief port and before assembly of the flow control components therein.
Figure 5:
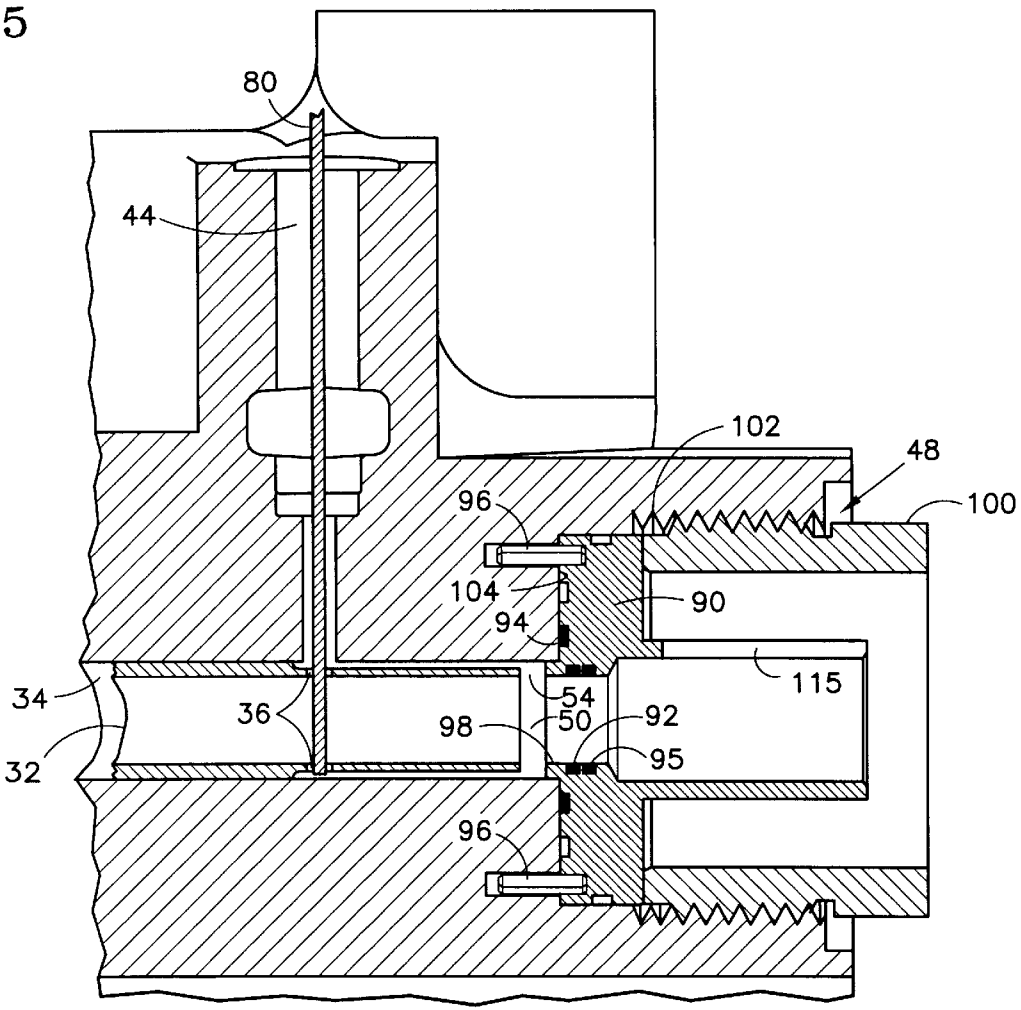
FIGS. 5–8 comprise full sectional views similar to FIG. 4 illustrating various stages of assembly and calibration according to the method of the present invention.

Referring now to FIG. 1, a hydraulic lost-motion metering pump 20 includes a pump housing 22 containing a recess 24 which defines a reservoir 26. A working fluid, such as oil, is disposed in the reservoir 26, as is a bell crank assembly 28 which is eccentrically mounted on a shaft 30 and which is driven by a motor (not shown). The bell crank assembly 28 is secured to a hollow plunger 32 and reciprocates the plunger 32 between fully retracted and fully extended positions in a plunger bore 34. At least one, and preferably two or more bypass holes 36 extend through the wall forming the plunger 32. Referring also to FIG. 4, the plunger 32 includes a trailing portion 38 located on a trailing side of the bypass holes 36 which has an outer diameter sized to fit in a substantially fluid-tight fashion with the wall defining the plunger bore 34. The plunger further includes a leading portion 40 disposed on a leading side of the bypass holes 36 opposite the trailing side. The leading portion 40 has a diameter smaller than the diameter of the wall defining the plunger bore 34 so that fluid can flow freely between the outer surface of the plunger and the wall defining the plunger bore 34. The plunger 32 is open at a trailing end 42 to the oil in the reservoir 26.

Figure 2:
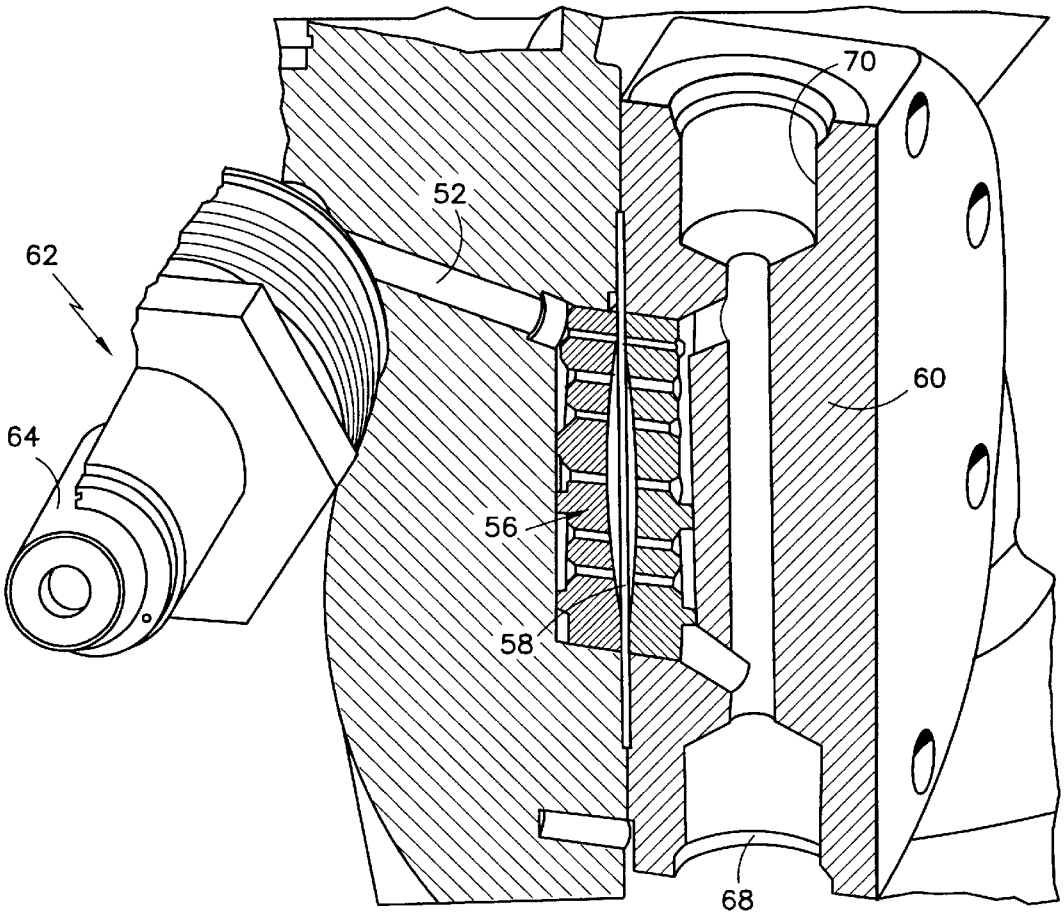
FIG. 2 comprises a trimetric view, with portions cut away, of the pump of FIG. 1 taken from a different viewing angle and illustrating the control rod and associated apparatus.
Figure 3:
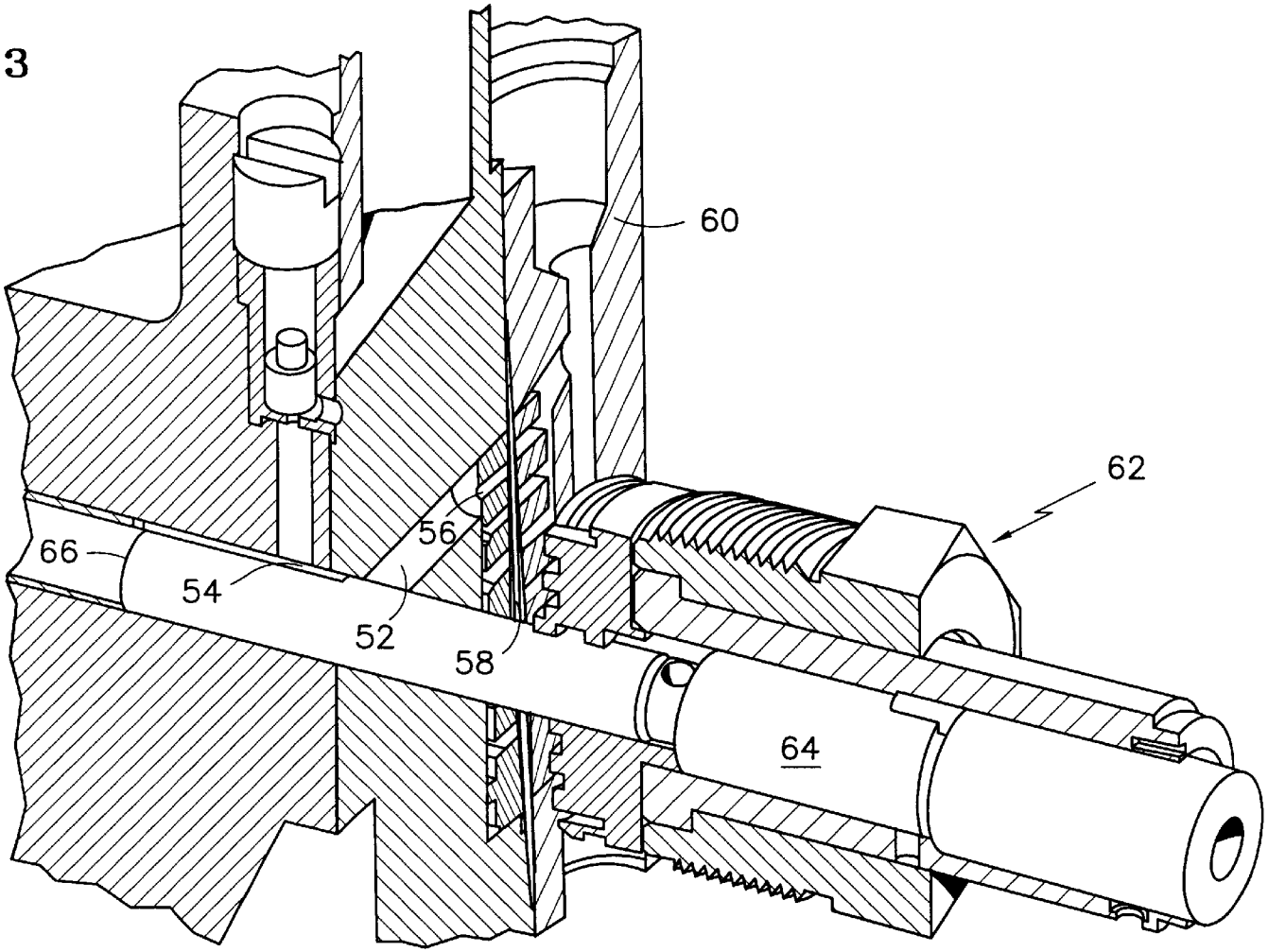
FIG. 3 comprises a trimetric view, with portions cut away, of the pump of FIG. 1 taken from yet another viewing angle and illustrating the liquid end of the pump.

A relief port 44 is formed in the pump housing 22 and a relief valve 46 (similar to that shown in FIG. 9) is disposed in the relief port 44. As seen specifically in FIG. 4, the pump housing 22 further includes a control rod bore 48 adjacent to and in communication with an end 50 of the plunger bore 34. As seen in FIGS. 2 and 3, a working fluid passage 52 extends between an intermediate chamber 54 (seen in FIG. 4 and which comprises the portion of the plunger bore 34 forward of the relief port 44) and a working chamber 56 which is partially bounded by a sealed diaphragm 58. A conventional liquid end 60 of the pump 20 is located on a side of the diaphragm 58 opposite the working chamber 56.

Figure 8:
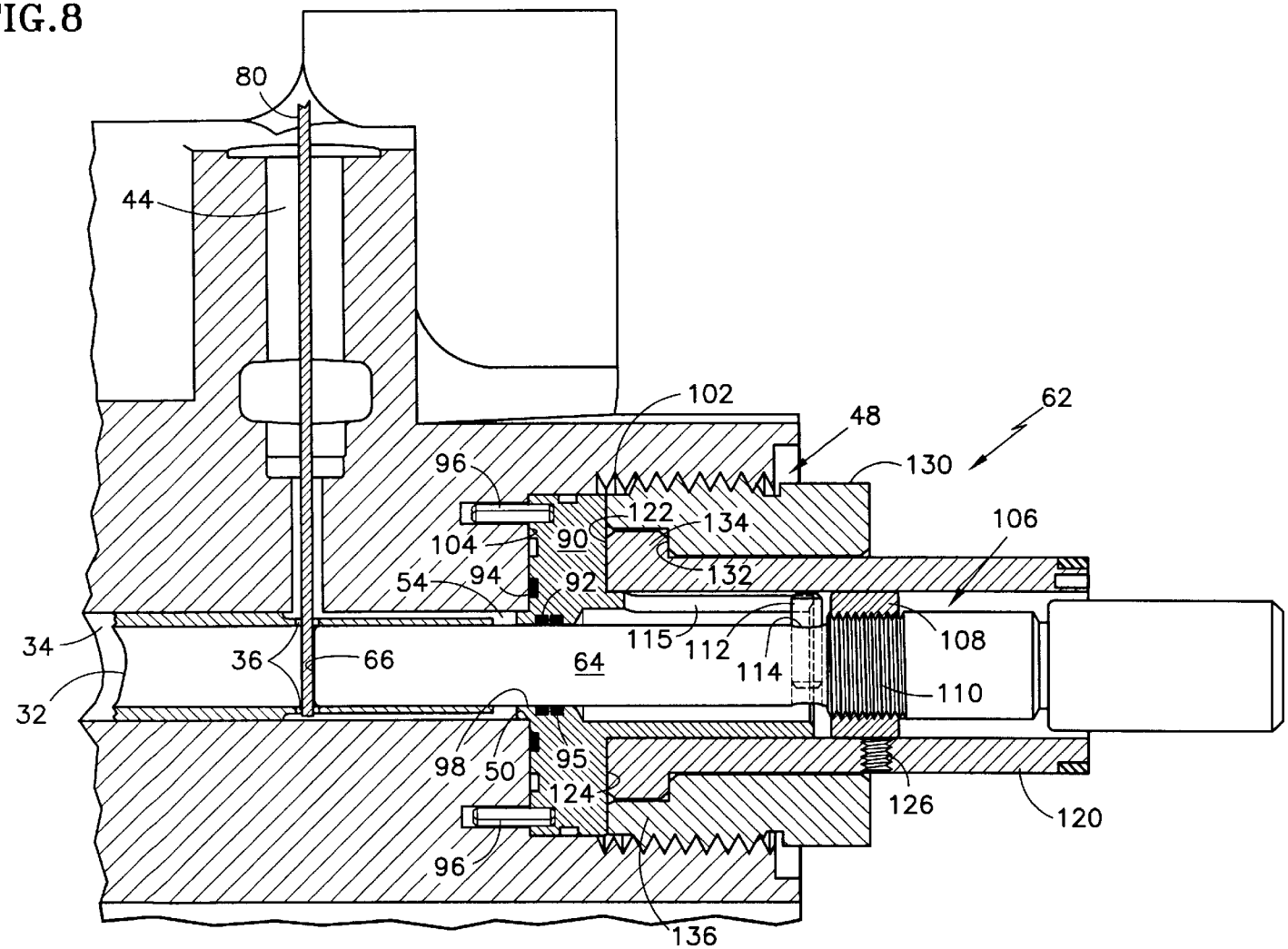

As seen in FIGS. 1, 3 and 8, a flow control assembly 62 is disposed in the control rod bore 48. The assembly 62 includes a control rod 64 which extends through the control rod bore 48 into the plunger bore 34 and into the hollow plunger 32. The outer diameter of the control rod 64 is sized to provide a fluid-tight fit with the inner surface of the plunger 32. The position of an end surface 66 of the control rod 64 determines the amount of process fluid pumped per stroke of the pump 20. Specifically, during operation of the pump 20, the plunger 32 is reciprocated to produce alternating suction and discharge strokes. At the beginning of a discharge stroke, as the plunger is moved toward the end 50 of the plunger bore 34 but before the bypass holes 36 are covered and blocked by the control rod 64, working fluid in the intermediate chamber 54 is circulated back to the reservoir 26 with no substantial pressurization of the fluid in the intermediate chamber 54. Accordingly, no process fluid is pumped at this time. However, once the plunger 32 has been moved forward to a point where the bypass holes are covered by the control rod 64, working fluid is trapped in the intermediate chamber 54, the passage 52 and the working chamber 56. Further displacement of the plunger 32 toward the end 50 of the plunger passage 34 pressurizes the working fluid in the working chamber 56, causing the pump 20 to expel process fluid out of the liquid end through a first set of check valves (not shown) located in a discharge recess 68 (FIG. 2) of the liquid end 60. The distance traversed by the plunger 32 from the point at which the bypass holes 36 are blocked to the fully extended position (during which the plunger 32 performs pressurization, as contrasted with the lost motion between the fully retracted position and the point at which the bypass holes are blocked by the control rod 64) determines the quantity of process fluid displaced during the pumping cycle.

During each suction stroke, as the plunger 32 moves from the fully extended position but before the bypass holes 36 are uncovered, the pressure of the working fluid in the intermediate chamber 54, the passage 52 and the working chamber 56 is reduced, thereby causing process fluid to be drawn into the liquid end 60 through a second set of check valves (not shown) disposed in an intake recess 70. The amount of process fluid drawn into the liquid end 60 during the suction stroke is dependent upon the distance between the fully extended position of the plunger 32 and the point at which the bypass holes are again uncovered by the control rod 64. Once the bypass holes 36 are uncovered, no further process fluid is drawn into the liquid end 60.

The method of the present invention will now be described in connection with FIGS. 4–8. The method may be performed at initial assembly of the pump 20, or may be undertaken subsequent thereto. Referring first to FIG. 4, the method may begin prior to assembly of the flow control assembly 62 and with the relief valve 46 (similar to that shown in FIG. 9) not present in the relief bore 44. The method begins with the step of manually or otherwise advancing the plunger 32 to the fully extended position, at which point the bypass holes 36 are aligned with the relief port 44. Once this alignment has been accomplished, a gage pin 80, which may be an elongate member of specified thickness, is placed into the relief port 44 such that it extends through one of the bypass holes 36 into the hollow interior of the plunger 32. Once these steps have been accomplished, the flow control assembly 62 may be inserted into and fixed in the control rod bore 48.

The flow control assembly 62 is assembled in the control rod bore 48 according to the sequence of steps illustrated in FIGS. 5–8. First, with reference to FIG. 5, a seal cap 90 together with associated shaft and seal rings 92, 94, back-up ring 95 and a pair of spring pins 96 are placed in the control rod bore 48 such that an annular collar 98 is fitted snugly within the end 50 of the plunger bore 34. A calibration retention nut 100 is threaded into a threaded portion 102 of the control rod bore 48 to temporarily retain the seal cap 90 against a wall 104 of the pump housing 22.

Figure 6:
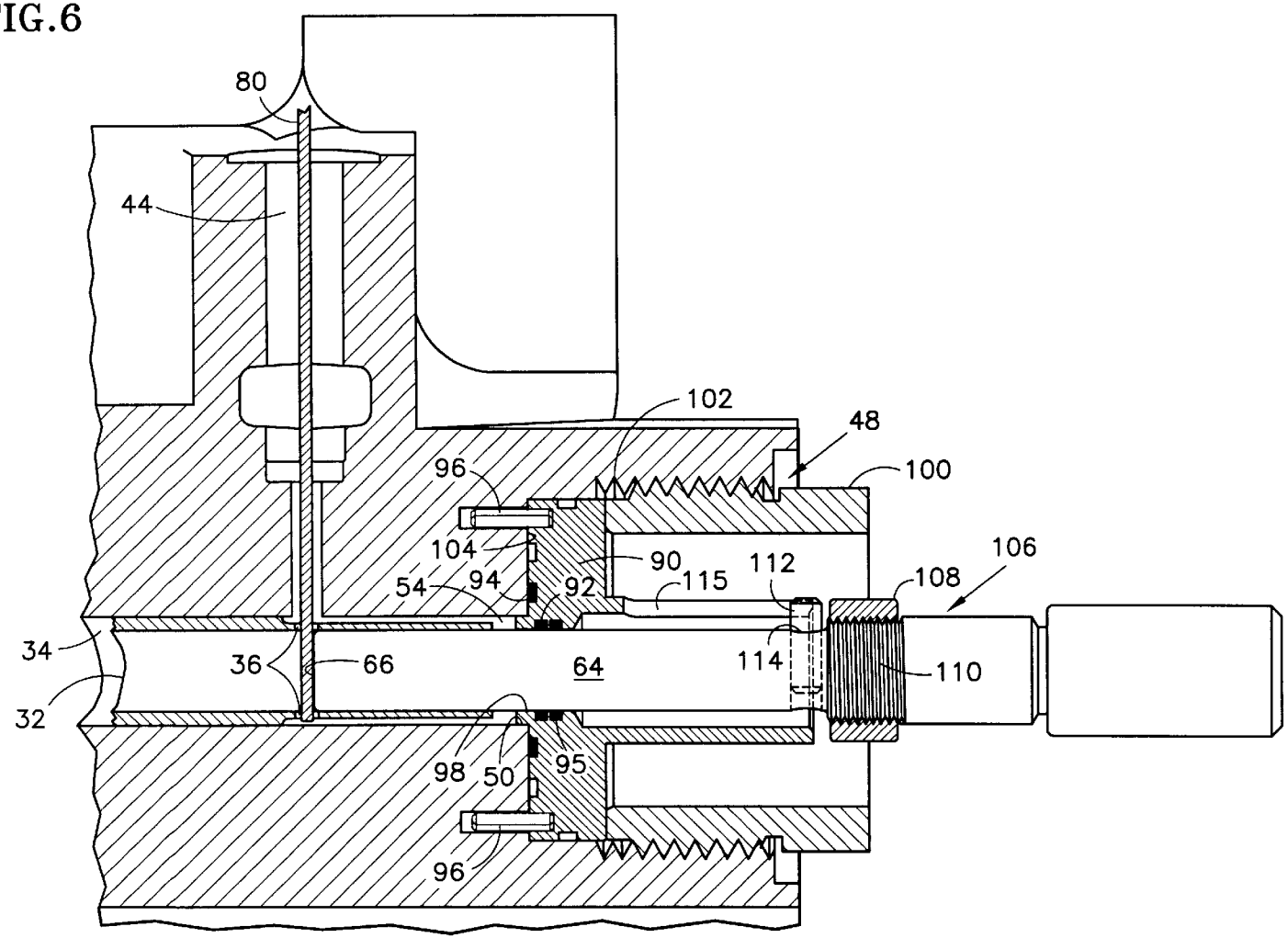

Next, as seen in FIG. 6, a control rod assembly 106 is placed in the control rod bore 48. The control rod assembly includes the control rod 64, a threaded ring 108, which is threaded on a threaded portion 110, and a hollow anti-rotation spring pin 112, which is placed into and retained in a rod bore 114. The end surface 66 of the control rod 64 is inserted into the end 50 of the plunger bore 34 and into the hollow interior of the plunger 32 until the end surface 66 of the control rod 64 abuts the gage pin 80 and such that the anti-rotation pin is disposed in a slot 115 formed in the seal cap 90. Preferably, the width of the gage pin 80 is selected so that the position of the end surface 66 when in abutment with the gage pin 80 and when the gage pin 80 is in abutment with the margins of the bypass hole(s) 36 results in a desired and repeatable calibration of the pump 20.

Figure 7:
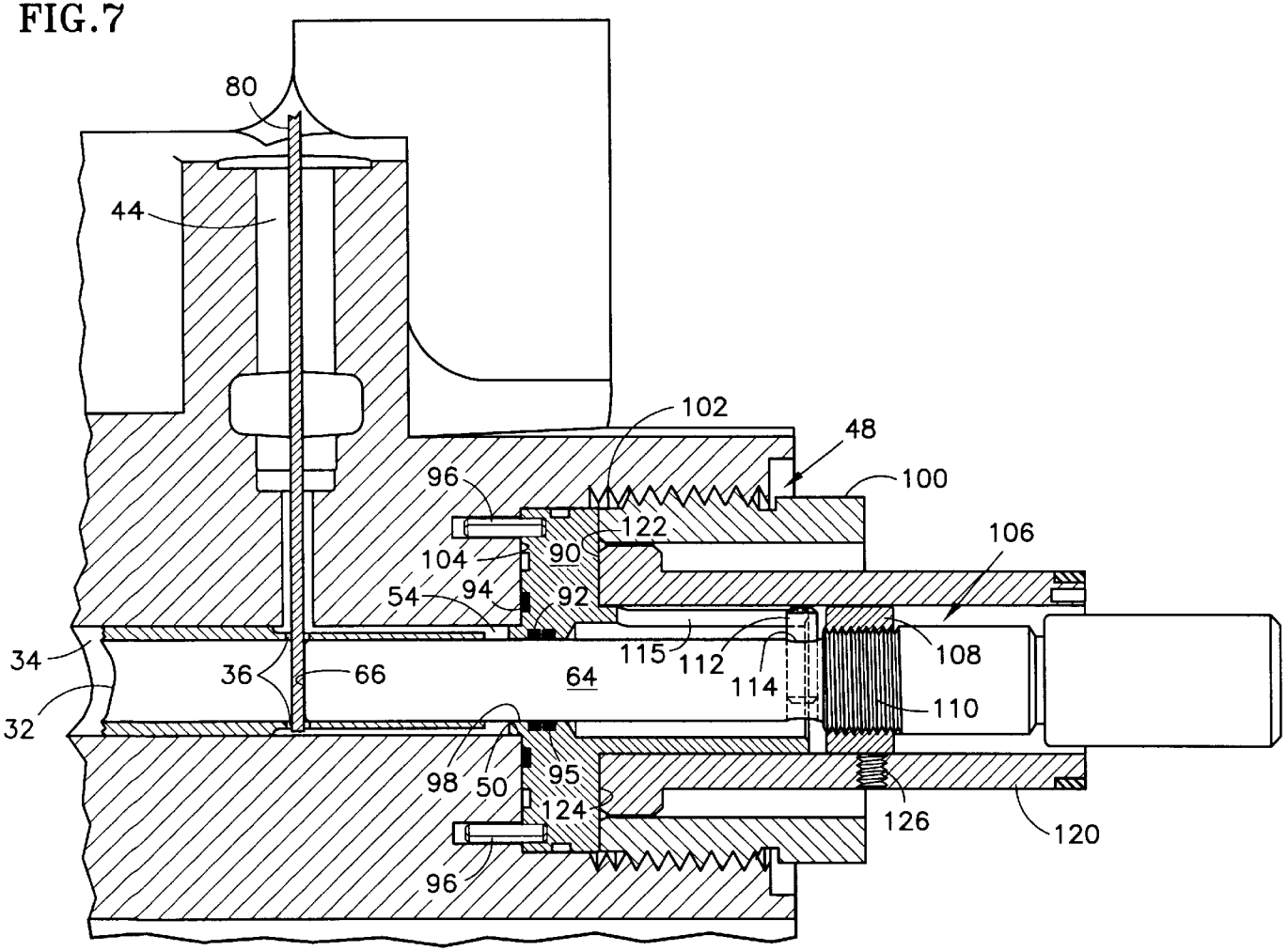

Referring next to FIG. 7, a knob 120 is then inserted into the control rod bore 48 surrounding the control rod 64 until a surface 122 of the knob 120 abuts a surface 124 of the seal cap 90. A set screw 126 is then tightened against the threaded ring 108 as the knob 120 is held in place so that the knob 120 is securely fixed to the threaded ring 108 and is rotatable therewith. As seen in FIG. 8, the assembly is completed by removing the calibration retention nut 100 (during this time the components are maintained in position by the control rod 64 and the seal cap 90) and threading a further retention nut 130 into the bore 48. The further retention nut 130 includes a shouldered portion 132 which captures an annular flange 134 of the knob 120. A nose portion 136 of the retention nut 130 has a length slightly greater than the axial dimension of the flange 134 so that the knob 120 is freely rotatable.

Once the foregoing is complete, the gage pin 80 is removed from the relief port 44 and the relief valve 46 is assembled therein. The flow rate of the pump 20 thereafter may be adjusted by turning the knob 120, which, in turn, results in rotation of the threaded ring 108. The control rod 64, however, is held against rotation by capturing of the anti-rotation pin 112 in the slot 115, and hence, rotation of the threaded ring 108 causes axial displacement of the control rod 64 (the control rod 64 includes threads to the right of the threaded ring 108 and which are engagegable by the threads of the ring 108). This displacement, in turn, advances or retracts the end surface 66, as desired.

Re-calibration after installation in the field can be accomplished in a simple fashion by removing the relief valve 46 (similar to that shown in FIG. 9) from the relief port 44, moving the plunger 32 to the fully extended position, removing the flow control assembly 62 and repeating the steps described above. This is a greatly simplified procedure as compared to the use of an air gauging setup.

It should be noted that the present invention comprehends calibration of a pump based upon positioning of the any portion of the control rod 64 relative to another point, such as a portion of the plunger 32 or a portion of the pump housing 22 (including the relief port 44 as described above). Thus, for example, the foregoing steps may be modified whereby a visually-observable mark is placed on a particular portion of the control rod 64 and the control rod 64 is inserted into the plunger 32 until the mark is visually observed to be coincident with a particular portion of the pump housing 22. Thereafter the rest of the components of the flow control assembly 62 are assembled as noted above. Alternatively, no mark may be utilized, in which case a particular portion of the control rod 64 is visually observed (or otherwise determined to be) coincident with a particular portion of another structure before securing the knob 120 thereto.

Figure 9:
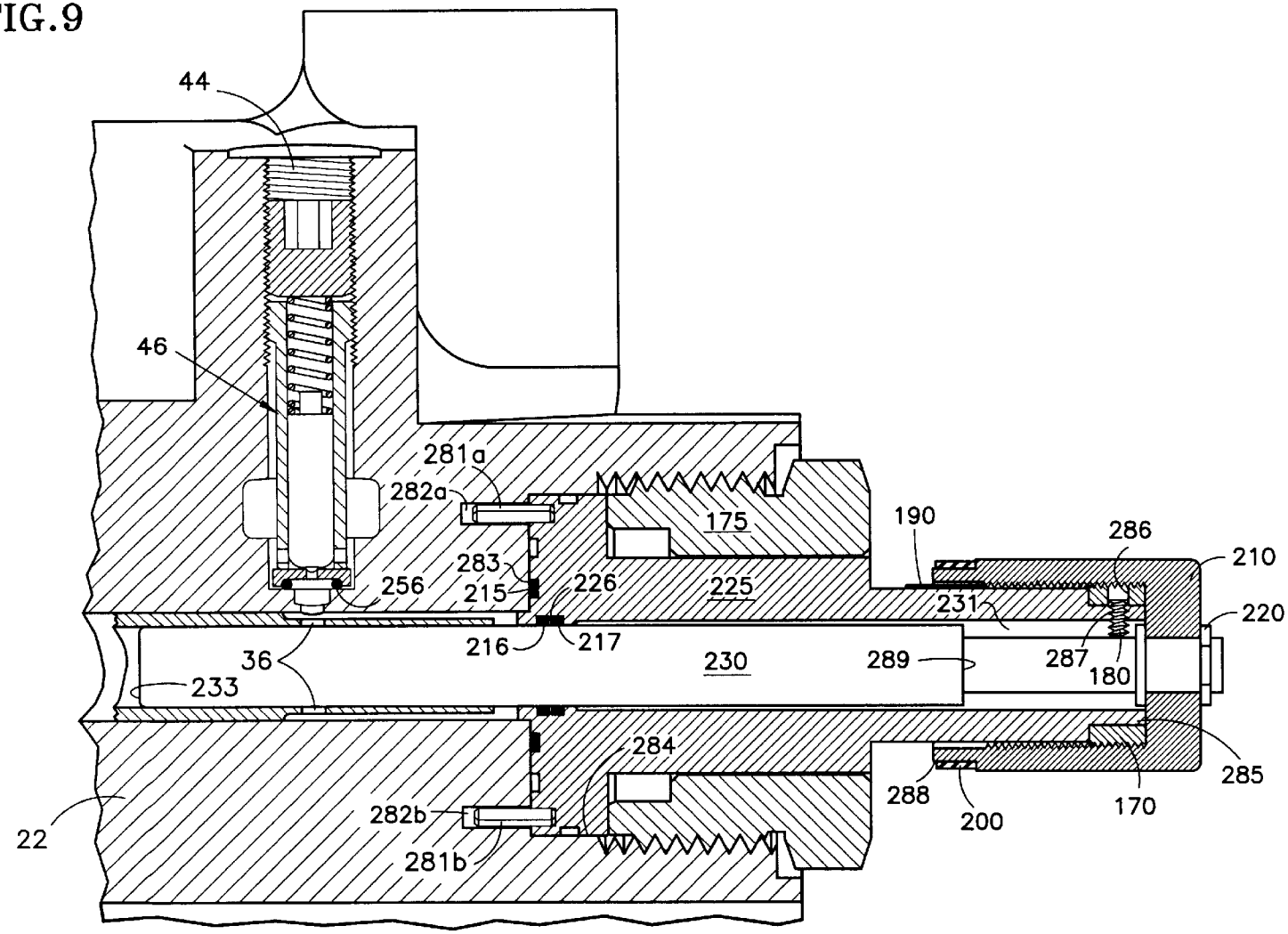
FIG. 9 is a full sectional view similar to FIG. 8 illustrating a pump design which may be calibrated in accordance with a further embodiment of the present invention.

Referring now to FIG. 9, an alternative pump design is illustrated and which may be calibrated according to an alternate embodiment of the present invention. Elements common to FIGS. 4–9 are assigned like reference numerals. Elements not shown in FIG. 9 are similar or identical to the pump of FIGS. 1–8. Also, FIG. 9 illustrates the various elements in assembled relationship, it should be understood that the parts are assembled and calibrated in a sequence of steps in a fashion similar to the sequence illustrated by FIGS. 4–8.

The assembly procedure begins by removing the relief valve 46 from the relief port 44 (if the valve 46 is present in the port 44) and then installing an O-ring 216 and a back-up ring 217 into a circumferential channel 226 in a seal cap 225. A control rod 230 is then inserted into a bore 231 in the seal cap 225 such that the O-ring 216 makes sealing contact with the control rod 230. Two alignment spring pins 281*a*, 281*b* are then inserted into corresponding bores 282*a*, 282*b*, respectively in the seal cap 225 and a face seal O-ring 215 is installed into a face seal channel 283 in the seal cap 225.

The seal cap 225 and installed components therein are then placed into a control rod bore 284. A retention nut 175 is then threaded into the control rod bore 284, thereby capturing the seal cap assembly in the pump housing 22. A ring 170 having a smooth inner bore and a threaded outer surface is loosely placed on an end 285 of the seal cap 225. A radial bore 286 in the ring 170 is aligned with a threaded bore 287 in the seal cap 225 and a stroke limit set screw 180 is threaded into the threaded bore 287 and extends into the bore 231 just short of contact with the control rod 230. A calibration ring 200 is then loosely placed over a reduced diameter portion 288 of an internally-threaded stroke adjustment knob 210 and the knob 210 is threaded onto the ring 170. An e-ring 220 is installed and captured onto an end of the control rod 230, thus capturing the stroke adjustment knob 210 to the control rod 230.

The structure of FIG. 9 is calibrated in a fashion similar to the embodiment of FIGS. 4–8. Specifically, the plunger 32 is manually or otherwise advanced to the fully extended position, at which point the bypass holes 36 are aligned with the relief port 44. Once this alignment has been accomplished, the stroke adjustment knob 210 is rotated counterclockwise (when looking at the end of the knob 210 from the outside of the pump) to cause the knob 210 and the control rod 230 to be displaced to the right as seen in FIG. 9 until a shoulder 289 of the control rod 230 contacts the set screw 180. At this point, an end 233 of the control rod 230 is located to the right of the bypass holes 36 in the plunger 32. The gauge pin 80 may then be inserted through the relief valve port 44 and into the bypass holes 36.

Once the gauge pin 80 has been inserted into the bypass holes 36, the stroke adjustment knob 210 is rotated clockwise until the control rod 230 contacts the gauge pin 80. At this point, the calibration ring 200 is affixed to the stroke adjustment knob 210 using any suitable adhesive or other securing means such that a legend "0" (zero) stamped in the calibration ring 200 is positioned facing straight up. The gauge pin 80 is then removed and the stroke adjustment knob 210 is rotated one full turn clockwise to achieve a zero percent capacity setting. A graduated percent stroke capacity sticker 190 is then affixed onto the seal cap 225 aligning a zero percent indicator line of the stroke capacity sticker 190 with the leading edge of the stroke control knob 210. The stroke adjustment knob 210 is then rotated ten full turns clockwise to achieve a 100% stroke setting. At this point, the relief valve 46 and a seal ring 256 can be installed in the relief port 44.

While this embodiment, like the first embodiment, utilizes the gauge pin 80 to position the control rod, it should be noted that any other manner of positioning the control rod could alternatively be used, as noted above. Also, any indicator other than the calibration ring 200 could alternatively be used, and/or the indicator could be placed on another part of the pump, if desired.

The gauge pin 80 may have a suitable diameter, such as 0.062", or any other diameter which results in a desired calibration.

Numerous modifications to the present invention will be apparent to those skilled in the art in view of the foregoing description. Accordingly, this description is to be construed as illustrative only and is presented for the purpose of enabling those skilled in the art to make and use the invention and to teach the best mode of carrying out same. The exclusive rights of all modifications which come within the scope of the appended claims are reserved.

What is claimed is:

1. A method of calibrating a lost-motion metering pump wherein the pump includes a relief port, a movable hollow plunger having a bypass hole which is aligned with the relief port when the plunger is moved to an aligned position and a control rod extending into the hollow plunger, the method comprising the steps of:

moving the plunger to the aligned position;

inserting a gage pin through the relief port and the bypass hole into the plunger;

moving the control rod into engagement with the gage pin; and fixing the position of the control rod.

2. The method of claim 1, wherein the step of fixing comprises the step of threading a retention nut into a control rod bore in which the control rod is disposed.

3. The method of claim 1, wherein the control rod includes a bore that receives an anti-rotation pin and including the further step of inserting a hollow seal cap having a slot into a pump housing and wherein the step of moving the control rod comprises the step of inserting the control rod through the hollow seal cap such that the anti-rotation pin is disposed in the slot.

4. The method of claim 3, wherein the step of fixing comprises the steps of inserting a hollow knob having a circumferential flange into the pump housing such that the hollow knob surrounds a portion of the control rod and a portion of the seal cap, securing the hollow knob to the control rod and threading a retention nut into the pump housing to capture the circumferential flange against the seal cap.

5. The method of claim 4, wherein a threaded ring is threaded onto the control rod and wherein the step of securing the hollow knob to the control rod comprises the step of threading a set screw into engagement with the threaded ring.

6. A method of calibrating a lost-motion metering pump wherein the pump includes a pump housing having a control rod bore, a relief port formed in the pump housing and adapted to receive a relief valve assembly, a movable hollow plunger having a bypass hole which is aligned with the relief port when the plunger is moved to an aligned position and a control rod extending into the control rod bore and the hollow plunger, the method comprising the steps of:

moving the plunger to the aligned position;

inserting a gage pin through the relief port and the bypass hole into the plunger while the relief valve assembly is removed from the relief port;

inserting a hollow seal cap having a slot into the control rod bore;

placing the control rod into the control rod bore through the seal cap and into engagement with the gage pin; and fixing the position of the control rod including the steps of inserting a hollow knob having a circumferential flange into the second bore surrounding a portion of the control rod and a portion of the seal cap, securing the hollow knob to the control rod and threading a retention nut into the second bore to capture the circumferential flange and the seal cap against the pump housing.

7. The method of claim 6, wherein the control rod includes a through bore that receives an anti-rotation pin and wherein the seal cap includes a longitudinal slot and wherein the step of placing the control rod comprises the step of inserting the anti-rotation pin into the longitudinal slot.

8. The method of claim 7, wherein a threaded ring is threaded onto the control rod and wherein the step of securing the hollow knob to the control rod comprises threading a set screw into engagement with the threaded ring.

9. A method of calibrating a flow control assembly of a lost-motion pump, the flow control assembly including a control rod and a knob, the lost-motion pump including a hollow plunger disposed in a pump housing, the method comprising the steps of:

inserting the control rod into the hollow plunger;

advancing the control rod into the hollow plunger until a particular portion of the control rod is aligned with respect to a certain portion of the pump housing; and securing the knob to the control rod when the control rod is aligned with respect to the pump housing.

10. The method of claim 9, including the further step of capturing an annular flange of the knob between a retention nut and the pump housing.

11. The method of claim 9, wherein the step of advancing comprises the step of moving the control rod until an end surface thereof abuts a gage pin.

12. The method of claim 9, wherein the step of securing comprises the step of threading a set screw into engagement with the control rod.

13. A method of calibrating a flow control assembly of a lost-motion pump, the flow control assembly including a control rod and a knob, the lost-motion pump including a relief valve port and a hollow plunger disposed in a pump housing and having a bypass hole, the method comprising the steps of:

advancing the hollow plunger to an extreme position such that the bypass hole is aligned with the relief port;

installing a gauge pin through the relief valve port into the bypass hole;

installing the control rod into the hollow plunger until the control rod contacts the gauge pin; and applying an indicator to the at least one of the flow control assembly and the pump at an aligned position while the control rod is contacting the gauge pin to calibrate the flow control assembly.

14. The method of claim 13, wherein the indicator comprises a ring bearing a mark.

15. The method of claim 14, including the further step of applying a sticker to one of the flow control assembly and the pump wherein the sticker includes markings thereon indicating the setting of the pump.

16. A method of calibrating a flow control assembly of a lost-motion pump, the flow control assembly including a control rod and a knob, the lost-motion pump including a hollow plunger disposed in a pump housing, the method comprising the steps of:

inserting the control rod into the hollow plunger;

advancing the control rod into the hollow plunger until a particular portion of the control rod is aligned with respect to a certain portion of the pump housing; and applying an indicator to at least one of the flow control assembly and the pump at an aligned position while the particular portion of the control rod is aligned with the certain portion of the pump housing to calibrate the flow control assembly.

17. The method of claim 16, wherein the indicator comprises a ring bearing a mark.

18. The method of claim 17, including the further step of applying a sticker to one of the flow control assembly and the pump wherein the sticker includes markings thereon indicating the setting of the pump.

* * * * *